US005542765A

United States Patent [19]

Smith et al.

[11] Patent Number: 5,542,765

[45] Date of Patent: Aug. 6, 1996

[54] CONTAINER FOR CARRYING FLOWABLE MATERIALS AND RELATED METHOD

[75] Inventors: Charles S. Smith, Cedartown; Hancel R. Wright, Rockmart, both of Ga.

[73] Assignee: Engineered Fabrics Corporation, Rockmart, Ga.

[21] Appl. No.: 232,769

[22] Filed: Apr. 25, 1994

[51] Int. Cl.[6] ..... B65D 33/14

[52] U.S. Cl. ..... 383/17; 383/67; 383/113

[58] Field of Search ..... 383/17, 19, 16, 383/41, 67, 113, 119

[56] References Cited

U.S. PATENT DOCUMENTS

| | | | |
|---|---|---|---|
| 2,612,924 | 10/1952 | Cunningham | 383/19 X |
| 2,672,902 | 3/1954 | Prager | 383/19 X |
| 2,696,235 | 12/1954 | Toffolon | 383/18 |
| 3,044,515 | 7/1962 | Eades | 383/19 X |
| 3,097,677 | 7/1963 | Mitchell | 383/19 X |
| 3,199,726 | 8/1965 | Pierson | 383/19 X |
| 3,356,120 | 12/1967 | Nohmura | 383/119 X |
| 4,113,146 | 9/1978 | Williamson | 383/18 X |
| 4,390,051 | 6/1983 | Cuthbertson | 383/17 X |
| 4,457,456 | 7/1984 | Derby et al. | 383/17 X |
| 4,807,299 | 2/1989 | Nattrass et al. | 383/19 X |

*Primary Examiner*—Jes F. Pascua

*Attorney, Agent, or Firm*—Renner, Kenner, Greive, Bobak, Taylor & Weber

[57] ABSTRACT

A collapsible container for carrying flowable materials includes a bag made of a plurality of layers of rubber-coated fabric and at least one lift assembly for lifting the container onto or out of a transport vehicle such as a railcar, truck or the like. The lift assembly is attached to straps or cords vulcanized into the plurality of layers of rubber-coated fabric. These straps or cords distribute the weight of the flowable materials within the container to other parts of the container, thereby providing the container with a suitable lifting capability.

10 Claims, 4 Drawing Sheets

CONTAINER FOR CARRYING FLOWABLE MATERIALS AND RELATED METHOD

TECHNICAL FIELD

The invention herein generally resides in the art of containers for carrying flowable materials. More particularly, the invention relates to collapsible containers which are suitable for storing and transporting these flowable materials on railcars, trucks, barges and the like. Specifically, the invention relates to collapsible containers which are capable of being lifted or otherwise utilized in the transportation and storage of the flowable materials. The flexible, air-tight containers of the present invention are designed to utilize space effectively and efficiently, and are capable of withstanding the stresses associated with their use when being lifted or filled with the flowable materials.

BACKGROUND OF THE INVENTION

Flexible, air-tight, collapsible containers for storing and transporting flowable materials such as fluids and finely divided particulate solids such as dry powders and the like have long been used in the transportation and material handling industries. These collapsible containers are typically made of rubber-coated nylon or tire cord fabric and are seen as an excellent way to reduce material handling and shipping costs because they not only provide a sufficient storage container for the flowable materials, but also can be readily transported on flatbed trucks, open railcars, barges, ships or the like. Moreover, because the flowable materials do not change storage containers during shipping, product loss and contamination is substantially eliminated.

Other methods of carrying and/or transporting such flowable materials are typically far more expensive and time consuming. For example, many materials are typically placed in paper bags, cartons or drums and loaded onto skids or other similar liftable devices so that the products can be transported to a particular destination. The process of stacking of the paper bags, cartons and drums on the skids require a significant amount of time and effort. Moreover, the skids used to transport the bags, cartons or drums waste a considerable amount of space. Because of their size and shape, collapsible containers are seen as being capable of carrying more material more efficiently than other types of storage and transportation containers. That is, the space required to store flowable material in a number of paper bags is significantly more than the space required to store the same amount of flowable material in a collapsible container.

While collapsible containers are seen as very useful in the material handling industry, only a small number of flowable materials are actually transported in collapsible containers at present. One of the reasons may be due to the lack of a suitable rubber-coated fabric from which the container can be made. Such a fabric must not only be flexible and air-tight, but also should be extremely durable on the inside, e.g., no chemical deterioration of the fabric, and on the outside, e.g., puncture resistant, friction resistant, chemical resistant, weather resistant, etc. In addition, the fabric should be easy to patch and repair, light weight, relatively long lasting and reusable.

Currently, one of the few known collapsible containers used today in the materials handling industry is available from American Fuel Cell and Coated Fabrics Company of Magnolia, Ark., under the trademark Fabribin. This collapsible container is made of puncture-resistant plies of tire cord fabric which is coated with neoprene and vulcanized into a one-piece, flexible bag. As flowable material is poured into the container, the bag typically expands or conforms to the shape of its environment. Typically, the Fabribin container is cylindrical in shape when not otherwise deformed.

The Fabribin container includes a hook receiving assembly generally positioned at the top of the bag and radially centrally thereof, for hoisting purposes. The hook receiving assembly generally includes a loop for receiving a hook or other means for lifting the container. However, in order to brace the bag from the extreme stresses associated with the lifting of the bag, a plurality of internal cables are positioned within the bag from the centrally-disposed, top hook receiving assembly to the bottom of the bag. These cables permit the weight of the material in the bag to be distributed to the bottom of the bag, thereby causing less stress on the top of the container during the lifting process.

Importantly, when lifting a collapsible container like the prior art Fabribin container, some type of mechanism is necessary to relieve the stresses placed on the point of lifting. Otherwise, due to the type of rubber-coated fabric used, the container could rip, tear or otherwise be damaged. By connecting the internal cables to the bottom of the bag, the Fabribin container provides additional points of lifting, thereby distributing the weight associated with lifting the bag to other pans of the container.

However, the internal cables are not without their drawbacks. In particular, the internal cables necessarily take up space inside the bag, thereby reducing the total available volume of the bag for filling with flowable material. Moreover, the internal cables are difficult to manipulate. Thus, when the collapsible container is to be collapsed, the internal cables may make the collapsing procedure more difficult. Still further, the internal cables have been known to hinder the emptying of the container. That is, certain compactable materials have been known to become wedged or lodged around the cables to such an extent that emptying the container becomes very burdensome.

In addition, the filling and emptying mechanism for the Fabribin container is quite small, thereby requiring substantial time and effort to fill and/or empty the container. Particularly, the fill/empty fitting preferred for the Fabribin container is less than about 6 inches in diameter. Thus, when compactable materials are used in the container, no clumps of material larger than about 6 inches can be emptied from the container. This adds significantly to the labor and handling costs associated with the filling and/or emptying of the container.

The hook receiving assembly employed and placement of the hook receiving assembly at the top center of the bag may also create problems with the Fabribin container such that it may not always function properly as a transportation container in railcars. Moreover, the container itself does not include any mechanism for suspending itself to an up-ender or other device while the container is being emptied.

Therefore, the need exists for a collapsible container having a flexible bag which can be filled, emptied or otherwise used to hold up to at least 20 tons of flowable material. The air-tight, collapsible container should also be capable of being lifted without any internal cables being exposed inside of the container.

DISCLOSURE OF INVENTION

In light of the foregoing, it is a first aspect of the present invention to provide a container suitable for carrying flowable materials at minimal handling and labor costs.

Another aspect of the present invention is to provide a container, as above, which is collapsible.

Still another aspect of the present invention is to provide a container, as above, which is made of a stronger, puncture resistant, flexible rubberized fabric.

Yet another aspect of the present invention is to provide a container, as above, which may be lifted with minimal stress on the lift point(s).

A further aspect of the present invention is to provide a container, as above, which may be lifted without the use of internal cables traveling through the interior of the container.

Still a further aspect of the present invention is to provide a container, as above, which includes a large enough access opening so that the container can be readily filled and emptied Yet another aspect of the present invention is to provide a container, as above, which can be loaded onto and easily transported a variety of vehicles including railcar, truck, barge or ship.

Still another aspect of the present invention is to provide a container, as above, which includes means to invert or suspend the container during the emptying process.

Yet a further aspect of the present invention is to provide a method for lifting a collapsible container.

The foregoing and other aspects of the invention, which will become apparent as the detailed description proceeds, are achieved by a collapsible container for carrying flowable materials. The container includes a flexible bag made from a plurality of layers of rubber-coated fabric; means to distribute the weight of the flowable materials within the container, the means to distribute being disposed between the layers of rubber-coated fabric; and means to lift the container, the means to lift operatively engaging the means to distribute.

Other aspects of the invention which will become apparent from the description herein are attained by a method for lifting a collapsible container with a lifting apparatus, comprising attaching at least one lift assembly to the lifting apparatus, said at least one lift assembly having a plurality of means disposed between layers of rubber-coated fabric which make-up the container to distribute the weight of the container and its contents to other parts of the container.

BRIEF DESCRIPTION OF THE DRAWINGS

For a complete understanding of the objects, techniques and structure of the invention, reference should be made to the following detailed description and accompanying drawings wherein.

PREFERRED EMBODIMENT FOR CARRYING OUT THE INVENTION

Figure 1:
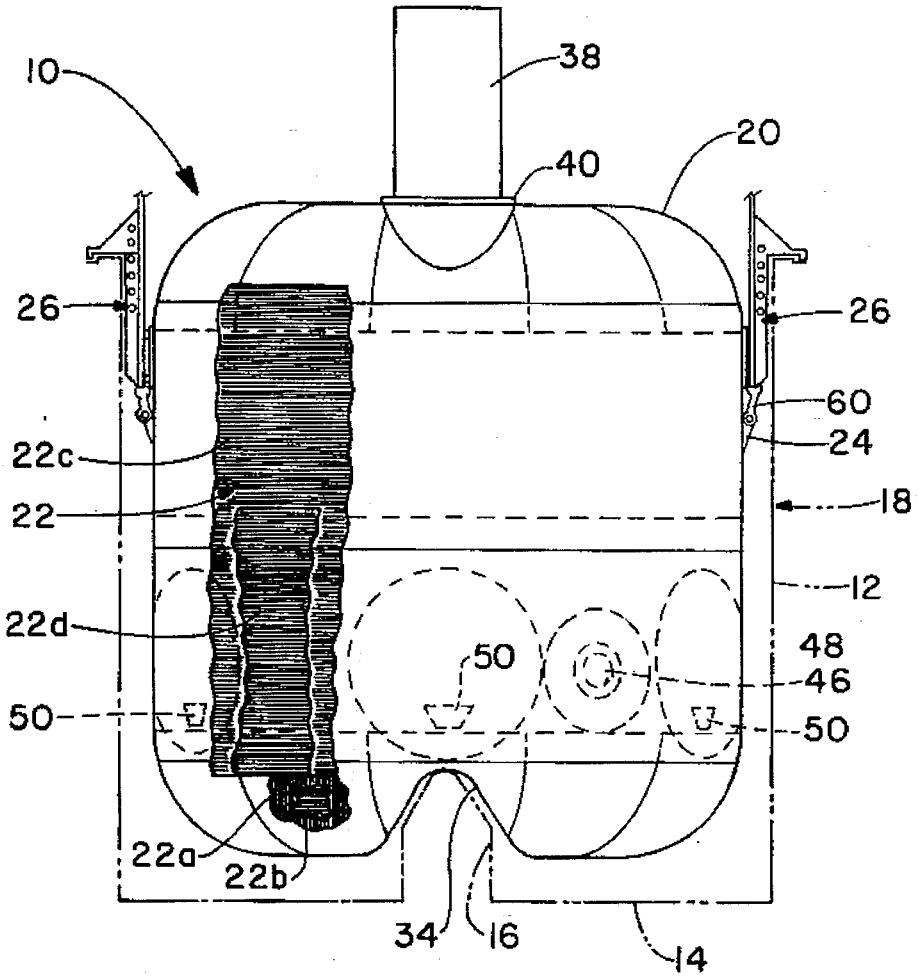
FIG. 1 is a front elevational view of one embodiment of a container of the present invention operatively positioned within a railcar.
Figure 3:
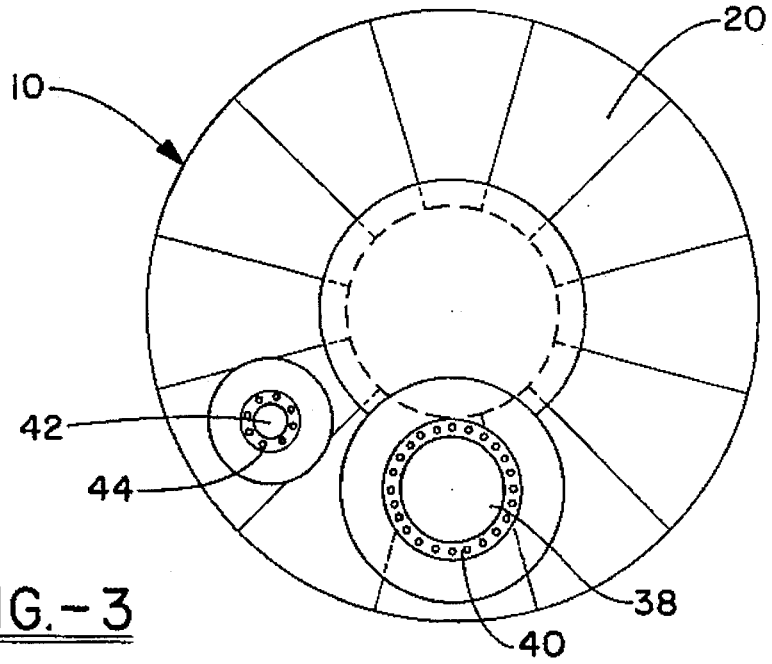
FIG. 3 is a top plan view of the container of FIG. 1.
Figure 2:
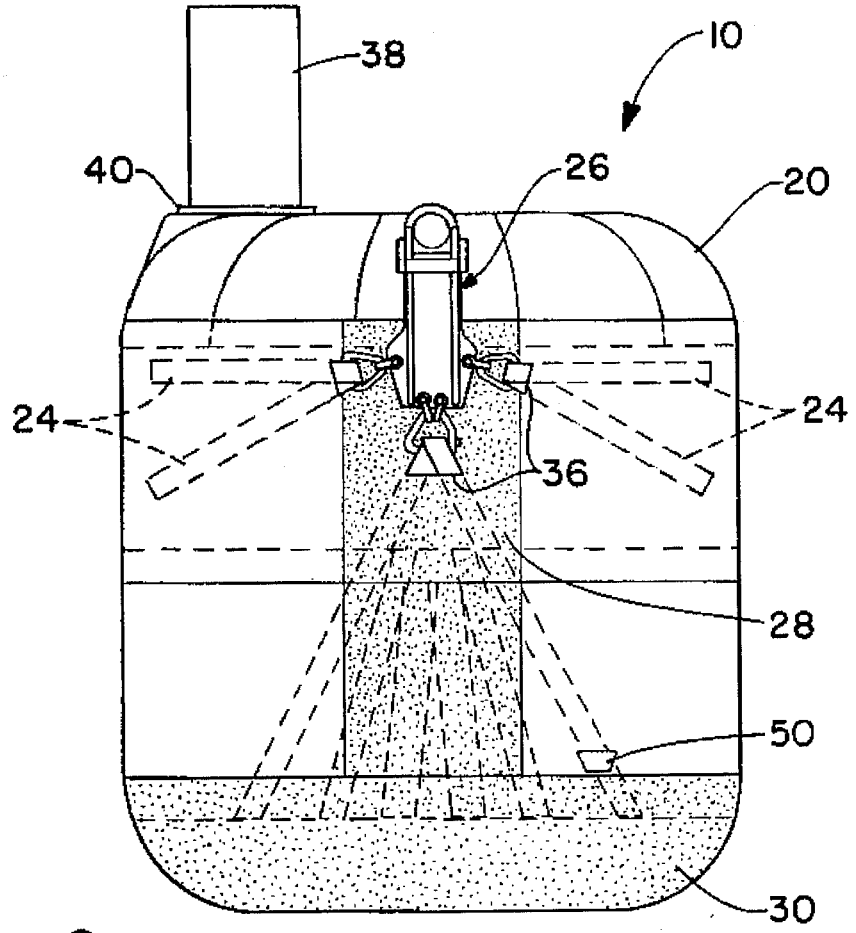
FIG. 2 is a side elevational view of the container of FIG. 1.

One representative form of a container embodying the concepts of the present invention is generally designated by the numeral 10 in FIGS. 1–3, and is shown in FIG. 1 operatively positioned between the sidewalls 12 and above the floor 14 and center seal beam 16 of an open-top railcar or other vehicle, designated generally by the numeral 18 and shown in phantom. The container 10 generally includes a flexible bag 20 made from a plurality of layers of rubber-coated fabric 22, for carrying the flowable materials therein, and is devoid of any internal cables as are present in at least one known collapsible container of the prior art. Instead, the container 10 includes means, such as straps 24 shown in FIG. 2, vulcanized into the layers of rubber-coated fabric 22 to distribute the weight of the flowable materials to other parts of the bag 20. The container 10 also includes means, such as lift assemblies 26 shown in FIGS. 1–3, for lifting the bag 20 out of the railcar 18. In this embodiment, and as more particularly seen in FIG. 2, the straps 24 are operatively engaged to at least one of the lift assemblies 26, thereby supporting and strengthening the container 10 during the lifting thereof when filled with the flowable materials.

The container 10 of the present invention is collapsible, meaning it can be folded within itself or otherwise manipulated for tarping and storage purposes. Such a container, like those of the prior art, is seen as particularly suitable for the transportation and storage of flowable materials such as fluids and dry solids including powders or other small particulate matter. As such, the container 10 is preferably cylindrical, although other shapes may be used if suitable for the storage and transportation purposes as detailed herein.

The bag 20 is the major component of the container 10. It is flexible and capable of conforming to practically any shape required for transportation. The bag 20 may be of any size suitable for the transportation means with it is being utilized, and for railcars, is preferably large enough to use most of the space therein, but the container does not contact the sides 12 of the railcar 18, which might be capable of puncturing or otherwise damaging the bag 20. As such, a bag measuring about 9 feet in diameter and about 10 feet in height is seen as exemplary.

Such a bag 20 is collapsible and should be able to withstand and perform in all types of extreme weather conditions, including high and low temperatures. The bag of the present invention is also very durable and air tight. It is puncture resistant, abrasion resistant, and chemical resistant. That is, the inside of the bag is water-tight and is capable of withstanding most acidic or alkaline chemicals as well as temperature ranging up to about 200° F. Yet, the bag 20 is light weight, long lasting, and flexible enough to withstand the numerous foldings when it is being collapsed.

These characteristics of the bag 20 are enabled by the rubber-coated fabric 22 used to make the bag 20 of the container 10. While similar to the rubber-coated fabric used for the containers of the prior art, the fabric 22 of the bag 20 is seen as a significant improvement thereover. Specifically, the bag 20 preferably includes at least one layer of a rubber-coated nylon fabric and at least one layer of a rubber-coated aramid fabric. Previously, rubber-coated tire cord fabric or rubber-coated nylon fabric was used. The addition of at least one rubber-coated aramid fabric significantly increases the strength and durability of the bag. Aramid is often referred to by one of its tradenames, Kevlar, a registered trademark of E. I. du Pont and Nemours, of Wilmington, Del.

As is well known in the art, the term "rubber-coated" refers to the fact that each ply of fabric is coated, preferably by a process known as calendaring, with an uncured rubber such as neoprene, nitrile rubber, vinyl rubber, polyurethanes or the like. The fact that the fabrics are coated with uncured rubber permits the layers of fabric to be vulcanized together or to be cured to some other article such as straps 24.

As can be seen in FIG. 1, the aramid fabric provides strength and toughness to the bottom of the bag 20. As such, the bottom of the bag 20 is preferably made from at least one ply of a rubber-coated nylon fabric, typically on the outside of the bag 20, and at least two corded plies of a rubber-coated aramid fabric, shown in FIG. 1 as 22*a* and 22*b*. It will be understood, however, that the outside of the bag may be made of the rubber-coated aramid fabric without departing from scope of the invention, the placement of the layers of fabric being dictated by its function and the manufacturer's preference. The sidewalls of the bag 20, which typically do not have to be quite as strong as the bottom of the bag, preferably include at least one ply of rubber-coated aramid fabric as well as at least one ply of rubber-coated nylon fabric. In FIG. 1, the outside of the bag provides the rubber-coated nylon fabric, while two other cord wraps of aramid fabric are shown as 22*c* and 22*d*. Notably, the innermost, second layer of aramid fabric 22*d* is shown only to cover the lower part of the bag 20. As indicated hereinabove, this is because more strength is required near the bottom to hold the contents of the bag 10. The first layer of fabric 22*c* is shown to encompass the entire height of the bag 20, although it will be understood that this layer 22*c* is necessary only to the extent the straps 24 are to be vulcanized between the fabric plies. Thus, if the straps 24 as shown in FIG. 2 are to be positioned along the sidewalls, then this layer of fabric 22*c* is only required to extend upwardly so as to cover (from the inside) the straps 24. In other words, although the top of the bag is shown as including at least two layers of material, the top may include only one ply of rubber-coated nylon fabric because it normally does not require the strength of the sidewalls or the bottom.

In addition, the sidewalls may also include an abrasion panel 28 as shown in FIG. 2. This abrasion panel 28 is preferably gum stock made of one of the rubber materials noted hereinabove, and extends down that portion(s) of the sidewall presented adjacent of the sidewall of the railcar. Thus, there is typically an opposing abrasion panel on the opposite side of the bag 20 as shown in FIG. 2. These abrasion panels 28 provide an area on the bag 20 which is even more puncture resistant and abrasion resistant so that the container will not sustain substantial damage from any abuse caused by the sidewalls of the railcar 18 or other vehicle during transit or when it is lifted into and out of the railcar 18 or other vehicle.

Similarly, the bottom of the bag 20 may include a similar abrasion panel 30 to provide further resistance to puncture or abrasion during transit or lifting. Typically, however, when the containers are to be used in railcars, a patch 32 such as that shown on the bottom of the bag 20 in FIG. 5 will suffice. The abrasion panel 30 and/or patch 32 increases the thickness of the bottom of the container, thereby providing a stronger, more durable bottom for the bag 20. Furthermore, when used in railcars, the bottom of the bag 20 may have a ridge 34 disposed thereacross to provide a space for receiving the center seal beam 16 of the railcar. Thus, effective use of all of the railcar is maintained.

For the embodiment shown in FIGS. 1 and 2, straps 24 are preferably made of nylon or polyester fabric and are vulcanized into the layers of fabric 22 so as to adequately distribute the weight of the contents in the bag 20, thereby insuring the lifting capability of the container 10. With specific reference to FIG. 2, the plurality of straps 24 generally extend in various directions between the layers of fabric 22 with at least some of the straps 24 extending upwardly from the lower part of the bag 20 at various angles predetermined to provide the bag 20 with sufficient lifting capability. Other straps 24 are seen to extend around the periphery of the bag 20. However, each of the straps 24 are generally angled in manner such that they protrude from various slits 36 in the bag and operatively engage a lift assembly 26, discussed hereinbelow.

At the top of the container 10, a sleeve 38, preferably greater than 10 inches in diameter and desirably at least 19 inches in diameter, may be disposed for filling and emptying the bag 20. Preferably, fill sleeve 38 is made of the same material as the bag 20, but sleeve 38 may include a rigid port assembly 40 for attaching the sleeve 38 to the bag 20. As best seen in FIG. 3, the port assembly 40 may be made of metal or other rigid material and is preferably securely attached to the bag 20. The flexible sleeve 38 can be readily connected to a filling pipe (not shown) or the like for filling and can also be attached to a pipe or the like for emptying the container. Typically, during transportation of the container, the sleeve 38 is tied or capped so as to prevent any flowable material inside from escaping. A sleeve of this size is seen as a significant improvement over the art inasmuch as previous containers were not as readily fillable or emptied.

A first vent 42 may also be provided on the top of the container to inject air or some other fluid. This vent 42, which preferably looks similar to the sleeve 38 only smaller (preferably, about 6 inches in diameter) and may include a port assembly 44 similar to the port assembly 40 for fill/empty sleeve 38, is believed to enhance the filling and emptying of the container 10 and can be used as an access for cleaning the inside of the bag 20. Generally, this vent 42 is opened during the filling process to rid the inside of the bag 20 of air, thereby permitting dust and other particles to properly settle into the container.

A second vent 46 may also be provided near the bottom of the bag 20 in the lower part of the sidewall. This vent 46 may also include a port assembly 48 similar to the port assembly 40 detailed hereinabove for the fill/empty sleeve 38. This vent 46, like first vent 42 is believed to enhance the filling and emptying of the container 10 and can be used as an access for cleaning the inside of the bag 20. However, unlike the first vent 42, this vent 46 is used to blow air into the bag 20 to push the particles out of the sleeve 38.

As is generally known in the art, the container 10 is preferably emptied by inverting the bag 20, or at least tilting the 10 so that the flowable material contained therein can flow out of the container 10 through sleeve 38. In order to tilt the bag 20, one or more tabs 50 may be provided in the lower part of the sidewalls of the bags 20 around the periphery of the container. Preferably, these tabs 50 are located on only one side of the bag 20 (typically, the front or back) to make tilting easier. These tabs 50 generally extend downward so as to permit the container to be suspended so that the contents of the container can be emptied. The tabs 50 are preferably made of the same material as the straps 24, and are preferably attached to the container by vulcanization between the outer rubber-coated fabric and a rubber-coated fabric patch 52. The patch 2 may be disposed on the inside or the outside of the container.

The container 10 may be inverted or tilted by any manner known in the art and is preferably inverted by a specially designed up-ender (not shown) which can invert the container up to about 180°. Most conventional up-enders tip containers like those of the present invention only about 90°. However, it is believed most conventional upenders can be modified to permit the container to be completely inverted.

As noted hereinabove, the container 10 is provided with a means for lifting it. One type of apparatus developed as part of the present invention includes the lift assembly 26 shown particularly in FIG. 2. This lift assembly is typically used to lift the containers from the railcar or other transportation vehicle. It is preferred that a lift assembly 26 be connected to and used on each side of the bag adjacent the sides of the railcar or other vehicle. This dual means of lifting the container has been found to be readily accessible to hook up to a crane or other lifting apparatus.

Figure 4:
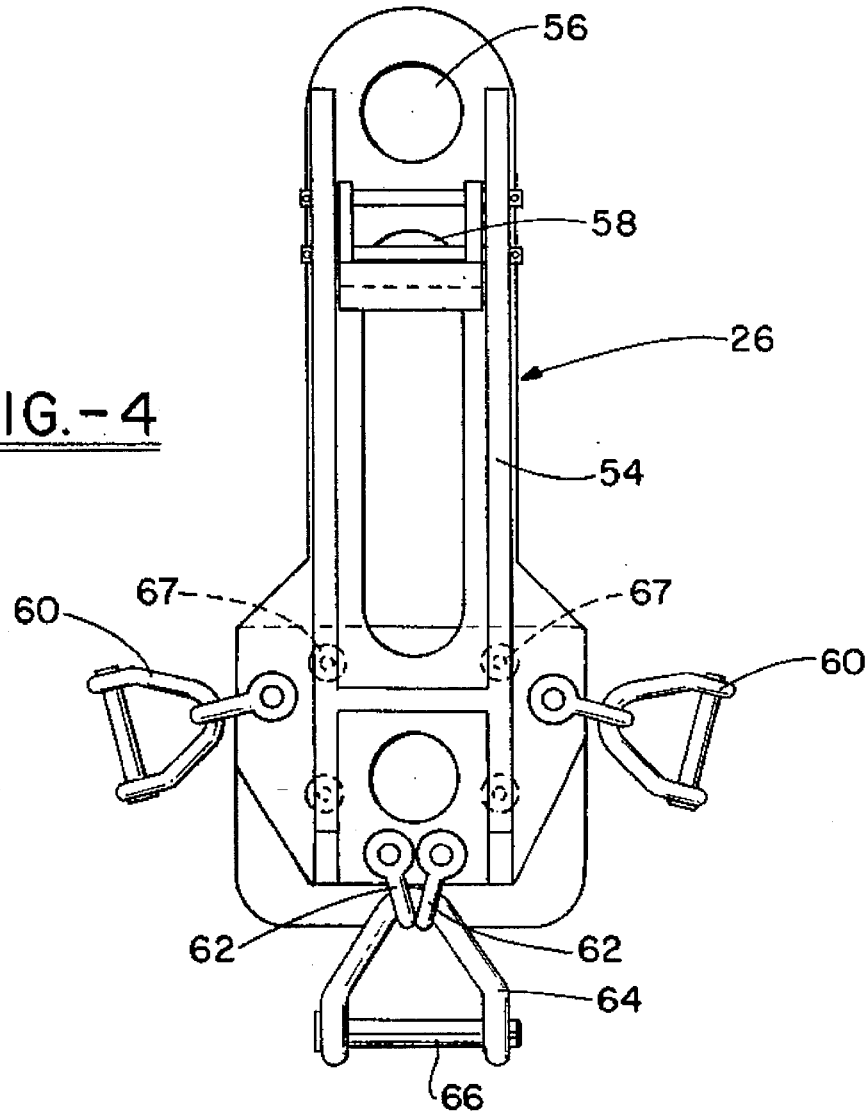
FIG. 4 is a side elevational view of a lifting mechanism used in conjunction with the container of FIG. 1.

With reference to FIG. 4, lift assembly 26 generally includes an elongated base portion 54 having an opening 56 near the top thereof for receiving a hook (not shown) or other mechanism for lifting the assembly 26, and therewith, the container 10. The lift assembly 26 also includes an adjustable means such as hook 58 to stabilize the container 10 against the sidewalls of the railcar or other vehicle while in transit. As can be seen in FIG. 1, the lift assemblies 26 may be held against the sidewalls 14 of the railcar 18 by this adjustable means 58 presented from the lift assembly 26 and engaging the top of the sidewall 14. Returning to FIG. 4, below the adjustable stabilizing means 58, the lift assembly preferably becomes much broader at its base portion 54 so as to provide at least one and preferably, a plurality of means to operatively attach the straps 24 to the lift assembly 26.

As best shown in FIG. 4, a plurality of shackles 60 are disposed on the base portion 54 of the lift assembly 26. Each shackle 60 includes at least one linking member 62 connecting a V-shaped armature 64 to the base portion 54. At the mouth of the armature 64 is received a bar 66 which engages the straps 24.

As best seen in FIG. 1, behind the base portion 54 and thereto by connecting means such as bolts 67 is a stabilizing plate 68. This plate 68 contacts but is not attached to the bag 20. Consequently, the only part of the lift assembly 26 attached to the bag 20 are the shackles 60 which are more particularly attached to the straps 24 vulcanized between the layers of fabric comprising the bag 20.

Figure 6:
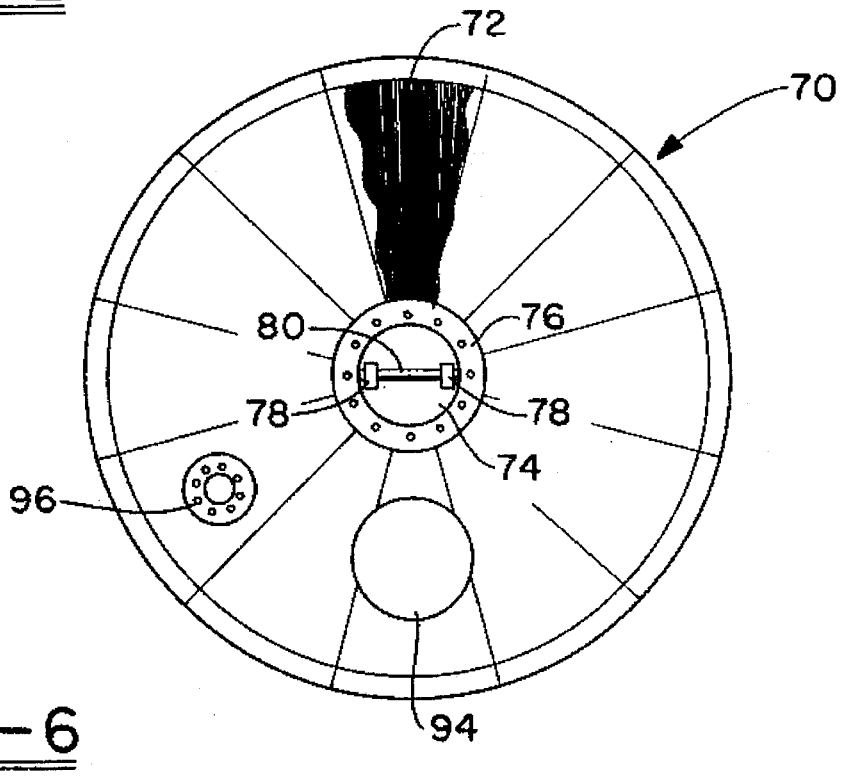
FIG. 6 is a top plan view of the container of FIG. 5.
Figure 5A:
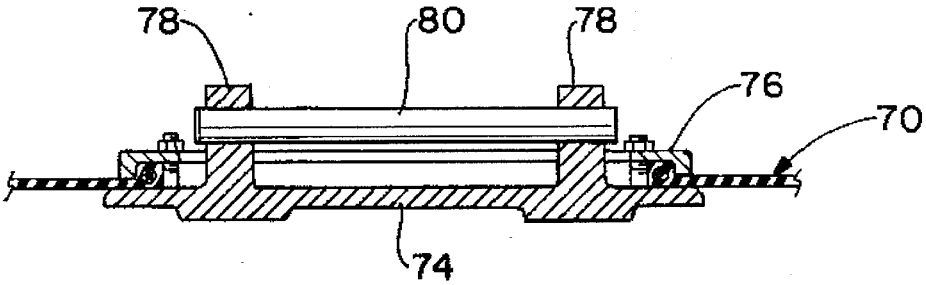
FIG. 5A is a sectional view of one embodiment of a lift assembly which can be employed on the container of FIG. 5.
Figure 5:
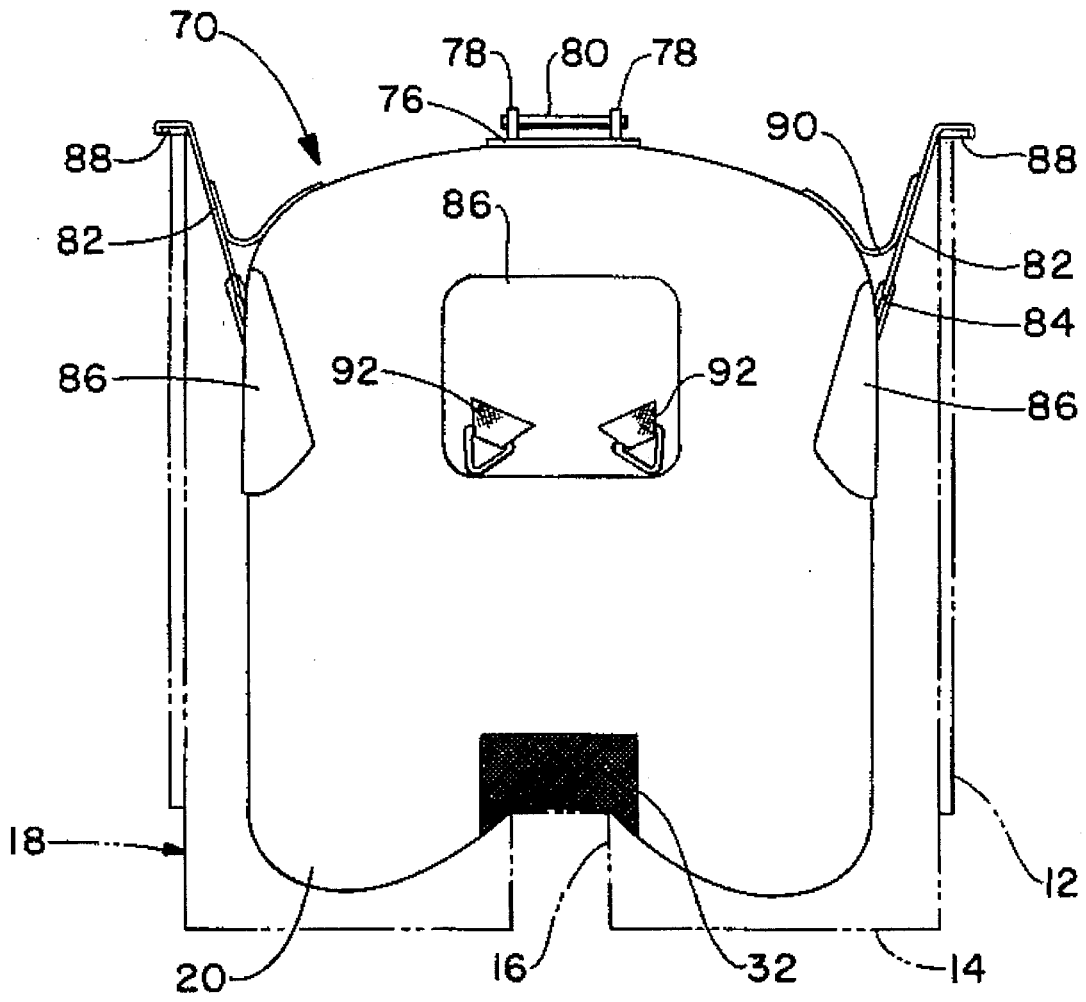
FIG. 5 is a front elevational view of another embodiment of a container of the present invention operatively positioned within a railcar.

An alternative embodiment of a container made according to the concepts of the present invention is shown in FIGS. 5 and 6 and is generally designated by the numeral 70 therein. Like FIG. 1, the container 70 in FIG. 5 is shown as disposed between the sidewalls 12 and the floor 14 with a center seal beam 16 of a railcar again designated generally by numeral 18. This embodiment of the container 70 includes essentially the same bag 20 as discussed hereinabove but does not have straps 24 or the lift assemblies 26. Instead, the weight of the flowable materials are distributed by means extending radially outwardly from the center of the top of the bag 20. The preferred materials suitable for the present invention. Generally, the cords 72 extend from a means to distribute the weight of the flowable materials, as shown in this embodiment, includes a plurality of reinforcement cords 72, preferably made of nylon or other materials suitable for the present invention. Generally, the cords 72 extend from a centrally disposed lift assembly 74 on the top of the container 70 to the radial periphery of the container 70. Preferably, the cords 72 extend down at least a portion of the sidewalls of the container 70.

The lift assembly 74 preferably includes a base portion 76 securely attaching the lift assembly 74 to the container 70, the base portion 76 including two posts 78 presented therefrom which receive a bar 80 to create means for receiving a hook or similar device (not shown). Alternatively, the lift assembly 74 may include a pin with an opening therethrough as is well known in the art.

When a centrally disposed lift assembly such as 74 is used on the top of the container 70 the present invention, additional means for stabilizing the container 70 while the container 70 is in transit in a railcar or other vehicle may be provided. As best seen in FIG. 5, a hook member 82 may be provided. Such a hook member 82 is typically attached to holding straps 84 vulcanized into the container 70. Preferably, the straps 84 are vulcanized between a patch 86 disposed on the outside of the container 70 and the outer layer of the bag 20, both of which are preferably made of rubber-coated fabric. The end of the hook member 82 is formed so as to properly hook over to top of the sidewall 12 of the railcar 18. The hook member 82 may include a rubber anti-slide pad 88 to prevent the hook from sliding during transit. In addition, means such as strip 90 attached to the bag 20 above the holding straps 84 may also may attached to the hook members 82 to provide additional support to the container during transit.

The container 70 shown in FIG. 5 also includes means such as binder straps 92 to attach the container to a vehicle at the front of the container 70. These binder straps are again preferably secured to the outside of the bag 20 with a patch 86 as detailed hereinabove.

The container 70 includes a fill/empty sleeve 94 and may also include at least one vent such as the vent 96 shown in FIG. 6 on the top of the container 70. These components are similar to and used for essentially the same purpose as the sleeve 38 and vent 42 disclosed hereinabove for the first embodiment of the container. It will be understood that any of the features or components of the first container 10 can be used on this alternative embodiment without departing from the spirit of the invention.

In use, the containers of the present invention may be filled with any flowable material including fluids and powders. To fill the containers, the fill sleeve 38 is opened and connected to a filling pipe (not shown). The flowable material is then poured into the container. As the container is filled, it expands and conforms to its surrounding environment. Generally, however, the container preferably takes a cylindrical shape.

The containers of the present invention are then lifted onto a transportation vehicle such as a railcar, truck, barge or the like by attaching a hook or other lifting mechanism of a lifting apparatus such as a crane to the lift assemblies 26 or 74 of the containers. Means such as the straps 24 or cords 72 of the containers allow the containers to be lifted by distributing the lifting weight of the material in the containers to other parts of the bag. The same process is performed when removing the containers from the transportation vehicle.

To empty the containers, they are preferably loaded onto an up-ender. There, straps such as those disclosed in the drawings as numeral 50 are attached to the device, and the containers are inverted. The contents in the bag are then emptied through the sleeve 38. During this process, the containers may be collapsed to push out all the contents therein. By collapsing the container, it is much more readily stored and takes up less storage space.

Thus it should be evident that the containers of the present invention are highly effective in providing a collapsible container which effectively utilizes all of the space available inside the container to carry flowable materials on railcars and other transportation vehicles. No internal cables or other components are found inside the bag. Rather, the container used other means found within the layers of rubber-coated fabric to adequately distribute the weight of the contents to lifting purposes. The invention is particularly suited for use as a storage and transportation compartment for flowable materials on railcars and the like, but is not necessarily limited thereto.

Based upon the foregoing disclosure, it should now be apparent that the objects of the present invention have been satisfied by the structure presented hereinabove, and that the use of the present invention described herein will carry out the objects set forth hereinabove as well. While, in accordance with the patent statutes, only the best modes and preferred embodiments of the invention have been presented and described in detail, it is to be understood that any variations evident fall within the scope of the claimed invention and thus, the selection of specific component elements can be determined without departing from the spirit of the invention herein disclosed and described. Accordingly, the scope of the invention shall include all modifications and variations that may fall within the scope of the attached claims.

What is claimed is:

1. A collapsible container having an interior for carrying flowable materials comprising:

a flexible bag made from a plurality of layers of rubber-coated fabric;

means to distribute the weight of the flowable materials within the container, said means to distribute being disposed outside the interior of the container between said layers of rubber-coated fabric forming the container; and at least one lift assembly, separate from said means to distribute, including means to attach said means to distribute to said lift assembly.

2. A collapsible container according to claim 1, further comprising a top and wherein the container includes a pair of lift assemblies positioned on opposite sides of and near the top of the container.

3. A collapsible container according to claim 2, wherein said means to distribute includes a plurality of straps disposed around the periphery of the container, said straps engaging one of said lift assemblies.

4. A collapsible container according to claim 3, wherein said plurality of straps are made of nylon or polyester fabric.

5. A collapsible container according to claim 1, wherein said at least one lift assembly is centrally disposed on top of the container.

6. A collapsible container according to claim 5, wherein said means to distribute includes a plurality of cords extending radially outwardly from said centrally disposed lift assembly.

7. A collapsible container according to claim 1, further comprising a top and means to fill and to empty the container located in the top of the container.

8. A collapsible container according to claim 1, further comprising vent means for enhancing the filling and emptying of the container and for cleaning the container.

9. A collapsible container according to claim 1, further comprising means to invert and suspend the container, said means being attached to at least one of said layers of fabric.

10. A method for lifting a collapsible container with a lifting apparatus, the container including an interior for storing its contents and at least one lift assembly, comprising:

attaching the at least one lift assembly to the lifting apparatus, the at least one lift assembly being attached to a plurality of means to distribute the weight of the container and its contents to other parts of the container, said plurality of means to distribute being disposed outside the interior of the container between layers of rubber-coated fabric forming the container.

* * * * *